US009403271B2

(12) United States Patent
Blake

(10) Patent No.: US 9,403,271 B2
(45) Date of Patent: Aug. 2, 2016

(54) TOOL TRAY APPARATUS AND SYSTEMS FOR USE WITH AERIAL BUCKETS

(71) Applicant: Dewayne Eugene Blake, Mooresville, IN (US)

(72) Inventor: Dewayne Eugene Blake, Mooresville, IN (US)

(73) Assignee: Invoke 3D, LLC, Mooresville, IN (US)

( * ) Notice: Subject to any disclaimer, the term of this patent is extended or adjusted under 35 U.S.C. 154(b) by 0 days.

(21) Appl. No.: 14/329,937

(22) Filed: Jul. 12, 2014

(65) Prior Publication Data

US 2015/0014198 A1 Jan. 15, 2015

Related U.S. Application Data

(60) Provisional application No. 61/845,441, filed on Jul. 12, 2013.

(51) Int. Cl.
*B25H 3/06* (2006.01)
*E06C 7/16* (2006.01)

(52) U.S. Cl.
CPC ... *B25H 3/06* (2013.01); *E06C 7/16* (2013.01)

(58) Field of Classification Search
CPC ..... B65H 3/04; B65H 3/06; B65H 5/00; E06C 7/00; E06C 7/16; E06C 7/165
USPC ..... 206/372, 373, 493; 182/2.1, 2.4, 46, 47, 182/112, 129; 248/201, 213.2, 312.1, 248/316.7; 211/70.6
See application file for complete search history.

(56) References Cited

U.S. PATENT DOCUMENTS

| | | | | | |
|---|---|---|---|---|---|
| 4,706,918 | A * | 11/1987 | Wilson | E06C 7/14 | 182/129 |
| 5,878,837 | A * | 3/1999 | Kistner | B25H 3/04 | 182/129 |
| 5,967,259 | A * | 10/1999 | Williams | E06C 7/14 | 182/129 |
| 6,113,202 | A * | 9/2000 | Germano | B25H 1/12 | 206/373 |
| 6,361,003 | B1 * | 3/2002 | Keoun | B66F 11/044 | 248/213.2 |
| 8,899,380 | B2 * | 12/2014 | Chard | B66F 17/006 | 182/129 |
| 9,180,591 | B2 * | 11/2015 | McLean | B25H 3/04 | |
| 2008/0060959 | A1 * | 3/2008 | Hendrix | B25H 3/06 | 206/372 |

* cited by examiner

*Primary Examiner* — Bryon Gehman
(74) *Attorney, Agent, or Firm* — Reichel Stohry LLP; Mark C. Reichel; Natalie J. Dean

(57) ABSTRACT

The present disclosure relates to the field of tool staging and assembly trays and systems capable of attaching to aerial buckets and other elevated work stations. In particular, the present disclosure pertains to a tool tray device configured with an interior sidewall surface and one or more attachment saddles. Trays of the present disclosure may also comprise at least one ramp configured to provide a sloped surface from the base of the tray to the top of a sidewall.

8 Claims, 11 Drawing Sheets

TOOL TRAY APPARATUS AND SYSTEMS FOR USE WITH AERIAL BUCKETS

PRIORITY

The present application is related to, and claims the priority benefit of, U.S. Provisional Patent Application Ser. No. 61/845,441 filed Jul. 12, 2013, the contents of which are hereby incorporated by reference in their entirety into the present disclosure.

BACKGROUND

Utility linemen are often required to work in elevated workstations such as utility trucks with aerial buckets. These aerial buckets are typically located at the end of an extendable hydraulically driven arm that is attached to a truck or other vehicle and are capable of lifting one or more linemen to elevated positions above the ground.

Once in position, the linemen is often required to perform repairs or assemblies utilizing many tools and small parts such as washers, nuts, and bolts. While performing the repairs and assemblies, the linemen normally required to wear leather gloves and may sometimes be required to wear thick electrically insulated gloves. These thick gloves make it significantly more difficult to grasp and manipulate small objects.

An aerial bucket typically consists of an open box configuration with a lip surface that extends around the upper open portion of the box. When removing and installing parts for their work, linemen are frequently handling small tools and hardware and for convenience lineman may occasionally place these items onto the lip of the bucket. Tools and hardware stored on the lip of the bucket have a high probability of falling off the lip resulting in lost hardware and productivity. The use of gloves when manipulating tools and hardware stored on the lip of the bucket further increases the probability that an item will fall off the bucket lip.

To solve this problem, there are several related inventions known in the art. For example, hardware storage devices such as bag type apparatuses are configured with one or more grommets capable of receiving hooks that are attached to the lip of the aerial bucket. These bag devices contain a plurality of pockets for storing and organizing tools and hardware. However, when using gloves linemen can have great difficulty retrieving and manipulating specific items in the pockets of these bag storage devices.

Therefore, a need exists for a new storage and hardware staging tray that is capable of attaching to the lip of aerial buckets and other raised workstations, and is able to facilitate the manipulation and organization of small pieces of hardware by gloved hands.

BRIEF SUMMARY

The present disclosure relates to novel tool tray apparatus embodiments for use with an elevated workstation such as an aerial bucket commonly found on utility trucks. In at least one embodiment, the present disclosure relates to a tool tray apparatus having an interior sidewall surface, one or more means for attaching the apparatus to an elevated workstation, and optionally, one or more means for facilitating the storage and manipulation of small tools and hardware by gloved hands.

In various embodiments, the present disclosure provides a novel tool tray apparatus having the capability of attaching to various elevated work stations including aerial buckets. The present disclosure comprises an interior tray surface bordered by four sidewalls and one or more means for attaching the device to an elevated workstation, which may comprise one or more saddles which are capable of engaging with a means for securing the device to the lip of an aerial bucket or other raised workstation. In some embodiments, the device further comprises one or more ramps capable of providing a sloped transitional surface from the base of the interior surface to the top of one or more sidewalls. In other embodiments, the device also comprises a means for storing and organizing hardware such as nuts and washers through a removable, vertically oriented dowel and stanchion. In these embodiments, the inclusion of a tray ramp, dowel, and stanchion help facilitate the manipulation and storage of hardware and tools by gloved hands.

In at least one exemplary embodiment of a tray of the present disclosure, the tray comprises an interior tray section configured to receive one or more items, the interior tray at least partially surrounded by at least one sidewall having a height, at least one attachment saddle coupled to the interior tray section, the at least one attachment saddle configured to receive a portion of an aerial bucket hook, and a first ramp portion in communication with the interior tray section, the first ramp portion defining a sloping surface that extends from the interior tray section to a top of the at least one sidewall. In another embodiment, one or more drain holes are defined within the interior tray section. In yet another embodiment, the tray further comprises a stanchion formed in or coupled to interior tray section, the stanchion configured to engage a removable dowel. In an additional embodiment, the tray further comprises the removable dowel, the removable dowel configured to reversibly engage the stanchion.

In at least one exemplary embodiment of a tray of the present disclosure, the tray defines at least one mounting slot therein, the at least one mounting slot configured to receive part of a self-locking cable tie. In an additional embodiment, the tray is configured for placement upon a lip of an aerial bucket, and wherein the tray is further configured to be retained upon the aerial bucket using the aerial bucket hook. In yet an additional embodiment, the tray further comprises a second ramp portion in communication with the interior tray section, the second ramp portion defining a second sloping surface that extends from the interior tray section to the top of the at least one sidewall. In another embodiment, the second ramp is located opposite the first ramp. In yet another embodiment, the second ramp is located adjacent to the first ramp.

In at least one exemplary embodiment of a tray of the present disclosure, the tray is formed of a non-conductive material. In another embodiment, the tray (or the one or more sidewalls of the tray) has an outer shape selected from the group consisting of a rectangular shape, a square shape, and a round shape.

In at least one exemplary embodiment of a system of the present disclosure, the system comprises a first tray, comprising an interior tray section configured to receive one or more items, the interior tray at least partially surrounded by at least one sidewall having a height, and a first ramp portion in communication with the interior tray section, the first ramp portion defining a sloping surface that extends from the interior tray section to a top of the at least one sidewall; and a tool board, wherein the first tray is coupled to or configured as part of the tool board. In another embodiment, the system is configured so that when the system is positioned upon a lip of an aerial bucket, the first tray is located above the lip and the tool board is positioned within the aerial bucket. In yet embodiment, the system further comprises a second tray coupled to or configured as part of the tool board, the second tray comprising a second interior tray section and a second ramp in communication with the second interior tray section. In an additional embodiment, the system further comprises one or more components coupled to a front portion of the tool board. In yet an additional embodiment, the system further comprises a stanchion formed in or coupled to interior tray section, the stanchion configured to engage a removable dowel, and the removable dowel, configured to reversibly engage the stanchion.

In at least one exemplary embodiment of a system of the present disclosure, the system comprises a first tray, comprising an interior tray section configured to receive one or more items, the interior tray at least partially surrounded by at least one sidewall having a height, and a first ramp portion in communication with the interior tray section, the first ramp portion defining a sloping surface that extends from the interior tray section to a top of the at least one sidewall; and at least one additional component connected thereto. In an additional embodiment, the first tray further comprises at least one attachment saddle coupled to the interior tray section, the at least one attachment saddle configured to receive a portion of an aerial bucket hook, and wherein the at least one additional component comprises a stanchion coupled to the tray. In another embodiment, the system further comprises a dowel configured for reversible engagement with the stanchion. In yet another embodiment, the at least one additional component comprises a tool board coupled to the tray.

BRIEF DESCRIPTION OF THE DRAWINGS

The disclosed embodiments and other features, advantages, and disclosures contained herein, and the matter of attaining them, will become apparent and the present disclosure will be better understood by reference to the following description of various exemplary embodiments of the present disclosure taken in conjunction with the accompanying drawings, wherein.

Figure 1A:
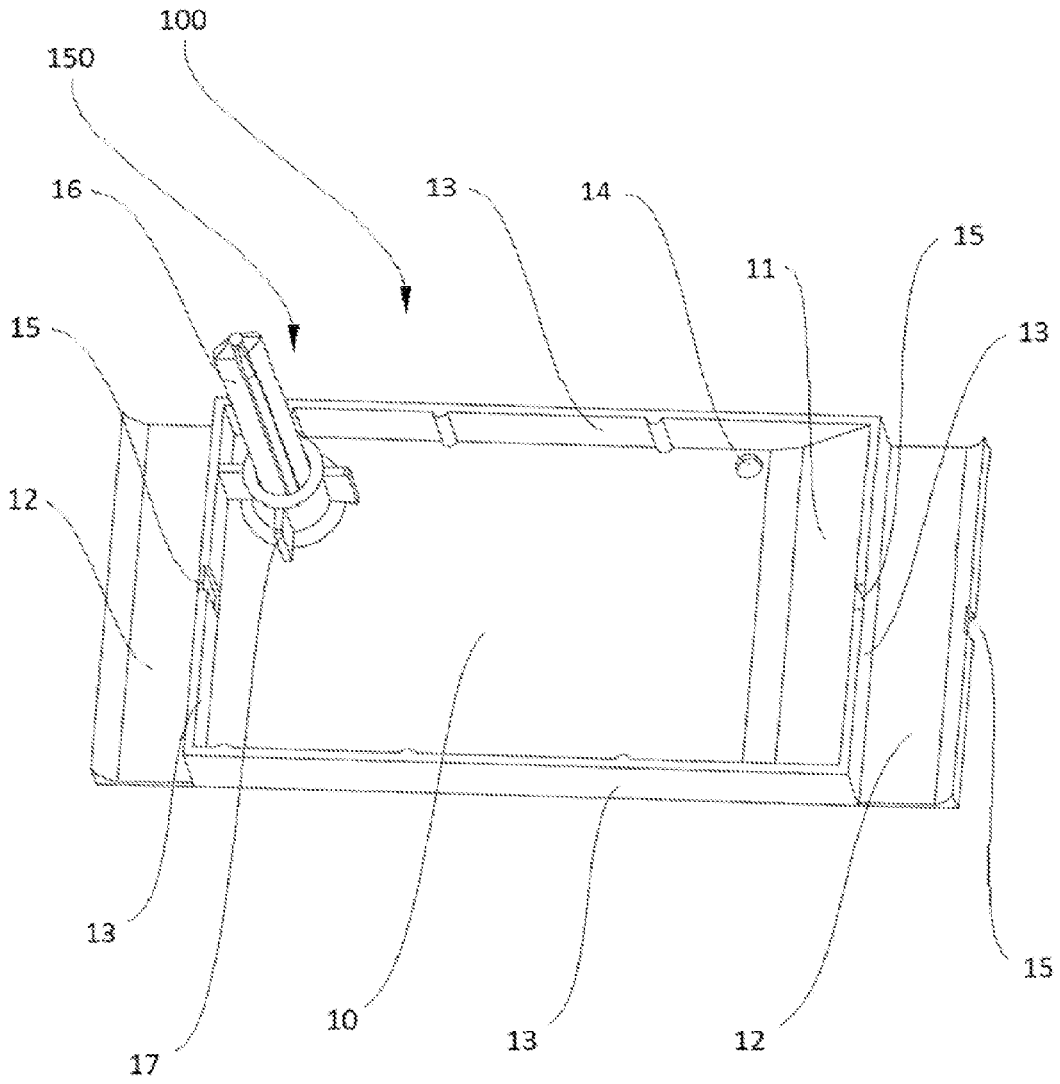
FIGS. 1A and 1B show a substantially top down view of an exemplary embodiment of a tray, according to exemplary embodiments of the present disclosure.

An overview of the features, functions and/or configurations of the components depicted in the various figures will now be presented. It should be appreciated that not all of the features of the components of the figures are necessarily described. Some of these non-discussed features, such as various couplers, etc., as well as discussed features are inherent from the figures themselves. Other non-discussed features may be inherent in component geometry and/or configuration.

DETAILED DESCRIPTION

For the purposes of promoting an understanding of the principles of the present disclosure, reference will now be made to the embodiments illustrated in the drawings, and specific language will be used to describe the same. It will nevertheless be understood that no limitation of the scope of this disclosure is thereby intended.

The terminology used herein is for the purpose of describing particular embodiments only and is not intended to be limiting of the present disclosure. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing embodiments of the present disclosure, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

New devices and apparatuses such as trays for use with elevated work stations and gloved hands are discussed. In the following description, for purposes of explanation, numerous specific details are set forth in order to provide a thorough understanding of the present disclosure. It will be evident, however, to one skilled in the art that trays and systems of the present disclosure may be practiced without these specific details.

The present disclosure is to be considered as an exemplification of the invention, and is not intended to limit the invention to the specific embodiments illustrated by the figures or description below.

Figure 1B:
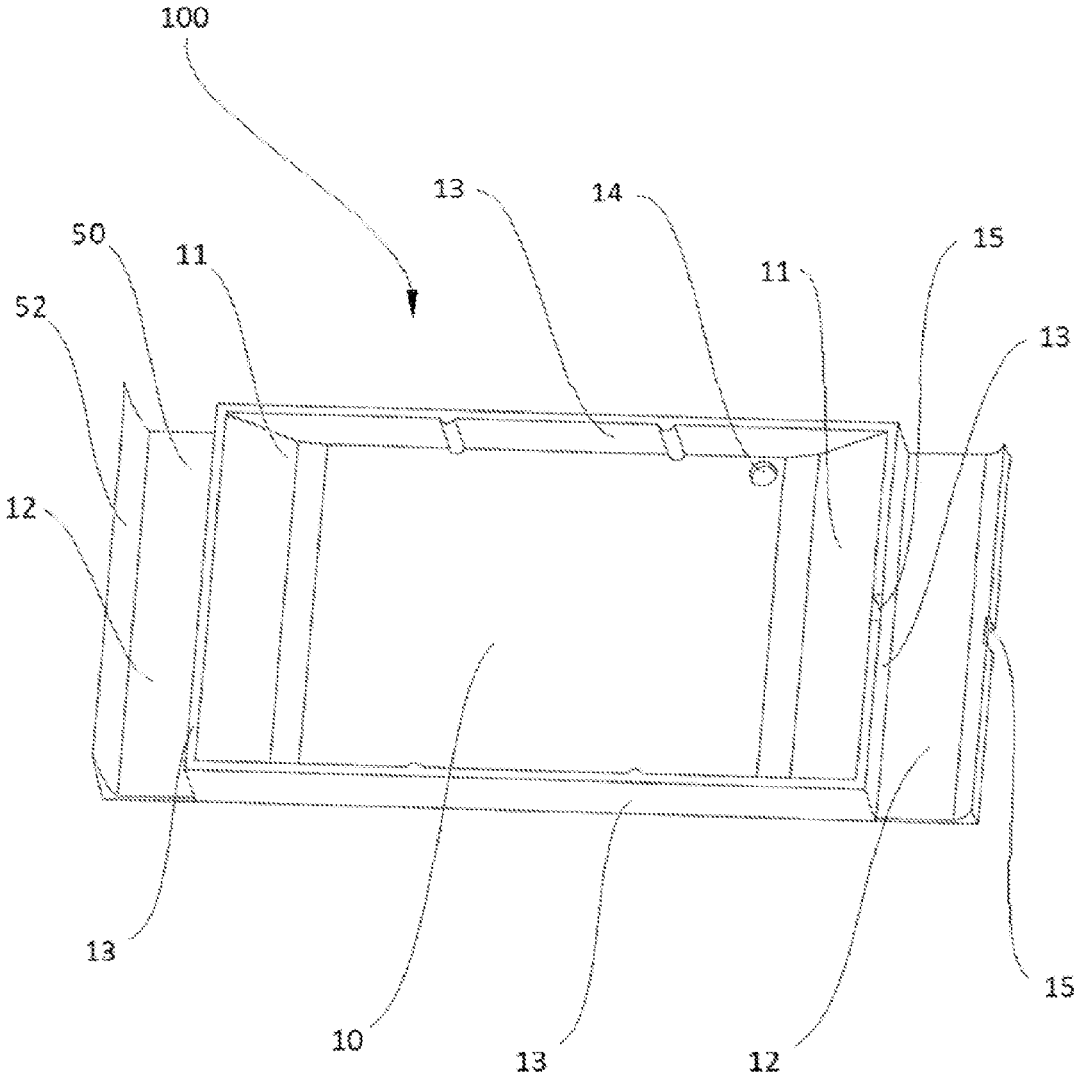
Figure 9A:
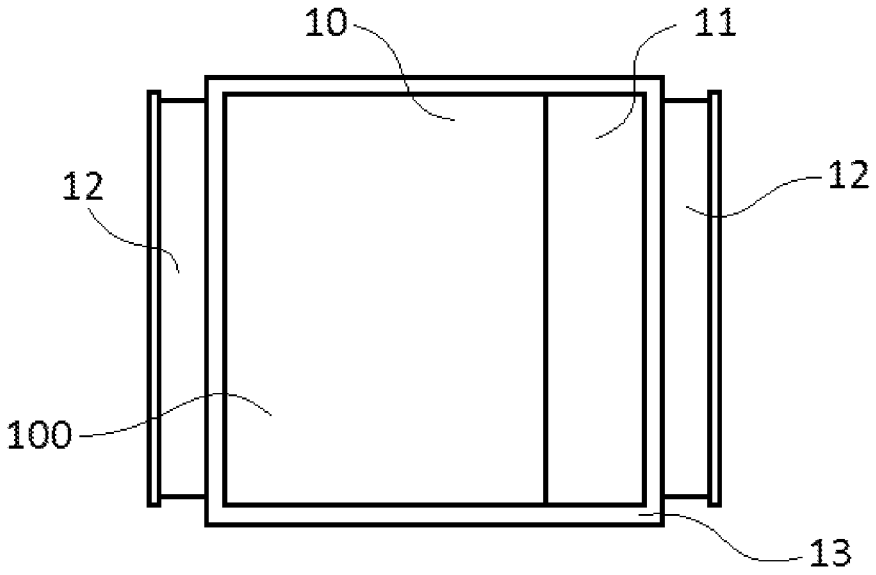
FIGS. 9A and 9B show top down views of a square tray and a round tray, respectively, according to exemplary embodiments of the present disclosure.
Figure 9B:
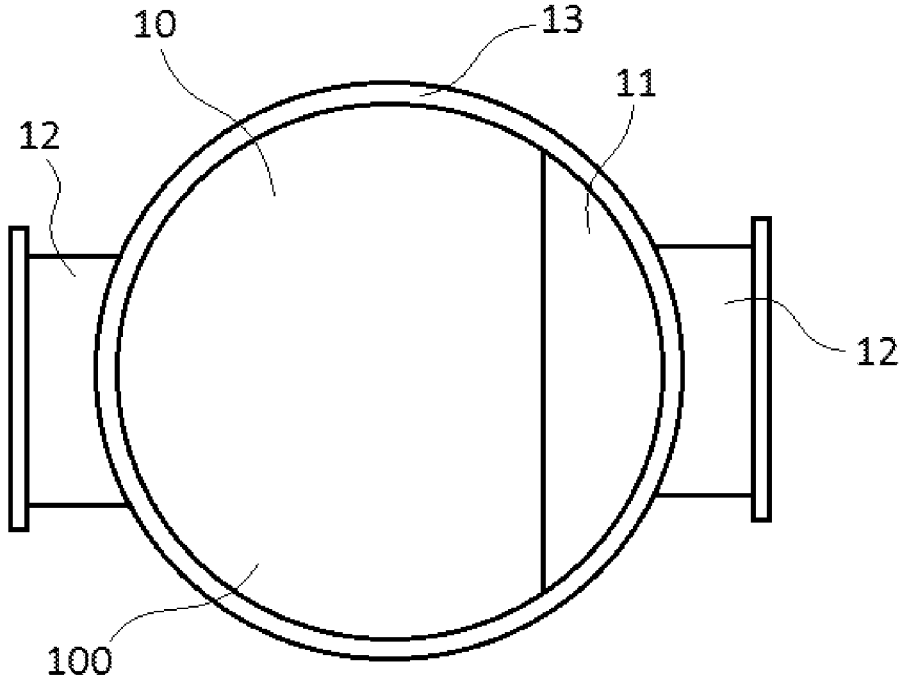

Various embodiments of the present disclosure will now be described by referencing the appended figures representing preferred embodiments. FIGS. 1A and 1B illustrates substantially top down views of exemplary embodiment of the present disclosure. In the examples shown in FIGS. 1A and 1B, tray 100 comprises an interior tray section 10 (also referred to as an interior tray base section 10) and one or more attachment saddles 12. The interior tray base section 10, as shown in FIGS. 1A and 1B, is formed and bound by four raised sidewalls 13, noting that in other embodiments the number of sidewalls 13 may differ, as provided in further detail herein. In some embodiments, the sidewalls 13 are 0.75 inches in height. In other embodiments, the sidewalls 13 may be between 0.5 inches and 3 inches in height, but other sizes and heights are contemplated herein. Furthermore, various relative "shapes" of trays 100 of the present disclosure, defined by an outer perimeter shape of one or more sidewalls 13, are contemplated herein, such as a rectangular shape (as shown in FIGS. 1A and 1B), a square shape (such as shown in FIG. 9A), a round shape (such as shown in FIG. 9B), and other potential shapes.

In the example shown by FIGS. 1A and 1B, the two attachment saddles 12 provide a means for accepting attachment devices configured to attach the tray 100 to an elevated workstation. In some preferred embodiments, the attachment saddles 12 are able to accept aerial bucket hooks 202 (as referenced in further detail herein) which fit over the attachment saddles 12 and around the lip of an aerial bucket. These aerial bucket hooks are common in the art and are used to hang tool bags, tool aprons, and the like to the lip of aerial buckets. In some embodiments, the tray 100 comprises one attachment saddle 12. In other embodiments, the tray 100 comprises two, three, or more attachment saddles 12. Attachment saddles 12, as shown in FIGS. 1A and 1B, may extend beyond interior tray section 10 in various directions. In addition, and as shown in FIG. 1B, the overall depth of attachment saddle 12 can vary, with a deeper attachment saddle 12 shown on the left side of tray 100 as compared to the attachment saddle 12 shown on the right side. As shown in FIG. 1B, an exemplary attachment saddle 12 of the present disclosure comprises an extension portion 50 (which can be considered as extending from tray 100, or extending out from a sidewall 13, for example), and a ridge portion 52, which is generally perpendicular, or at an angle of between 30° and 150°, for example, from extension portion 50. An exemplary aerial bucket hook 202, as referenced in further detail herein, can fit within attachment saddle 12 at extension portion 50, and is prevented from moving sideways due to the positioning of sidewall 13 adjacent to aerial bucket hook 202 and ridge portion 52. Depths of attachment saddles 12, as referenced herein, relates to a relative height of ridge portion 52 relative to extension portion 50, for example. Attachment saddles 12 can have various widths, lengths, and depths, depending on the desired embodiment. In addition, the configuration of an exemplary attachment saddle 12 is such that when an exemplary tray 100 is in use (and one or more aerial bucket hooks 202 are used with tray 100), tray 100 is retained by aerial bucket hook(s) 202 and cannot slide away from aerial bucket hook(s) 202 without moving aerial bucket hook(s) 202 in a way to disengage tray 100.

In some embodiments, the tray 100 comprises one or more ramps 11 (also referred to herein as a ramp portion 11). The ramp 11 forms a sloping surface that extends from the base of the tray interior base section 10 up to the top of a sidewall 13. This ramp 11 allows the user to slide hardware located on the interior tray section 10, up to the top edge of the sidewall 13, thereby facilitating the retrieval and manipulation of tools and hardware with gloved hands, for example. In various embodiments, and as shown in FIG. 1A, tray 100 comprises one ramp 11. In other embodiments, tray 100 may comprise two ramps 11 (as shown in FIG. 1B) providing a sloped surface to the tops of two separate sidewalls 13. In other embodiments, the tray 100 comprises three ramps 11 providing a sloped surface to the tops of three separate sidewalls 13. In still further embodiments, each of four sidewalls 13 of an exemplary tray 100 embodiment have a ramp 11 providing a sloped surface from the interior tray base section 10 to the top of each sidewall 13.

In some embodiments, and still referring to FIGS. 1A and 1B, the tray 100 may define one or more drain holes 14 which allow water or other liquids to exit the interior tray section 10. For example, and if the tray is positioned so that the view in FIGS. 1A and 1B faces upward as shown, rainwater entering tray 100 can drain through one or more drain holes 14 and out of tray 100. In various tray 100 embodiments of the present disclosure, tray 100 contains one or more mounting slots 15, also as shown in FIG. 1A. The mounting slots 15 are configured to accept attachment devices, such as self-locking cable ties, for securing the tray 100 to aerial bucket lips, scaffolding, and other types of elevated workstations, for example.

In some preferred embodiments, the tray 100 may comprise a stanchion 17 and an optionally a removable dowel 16 oriented in a vertical position above the tray 100, as shown in FIG. 1A. Dowel 16 provides a means for stacking and staging hardware, such as nuts, washers, and the like. Stanchion 17 keeps the hardware on dowel 16 from resting on interior tray section 10, thereby providing a large space for gloved fingers to grasp the lowermost hardware stacked on dowel 16. Dowel 16 may be removed from the stanchion 17 by any number of means, such as by a twisting and lifting motion, for example, and attached to the stanchion 17 by a reverse twisting and insertion motion. An exemplary system 150 of the present disclosure, as shown in FIG. 1A, comprises a tray 100 and at least one additional component, such as, for example, a dowel 16 and/or a stanchion 17. Other system 150 embodiments are referenced in further detail herein. Tray embodiments do not require a dowel 16 or a stanchion 17, as shown in FIG. 1B.

Figure 2:
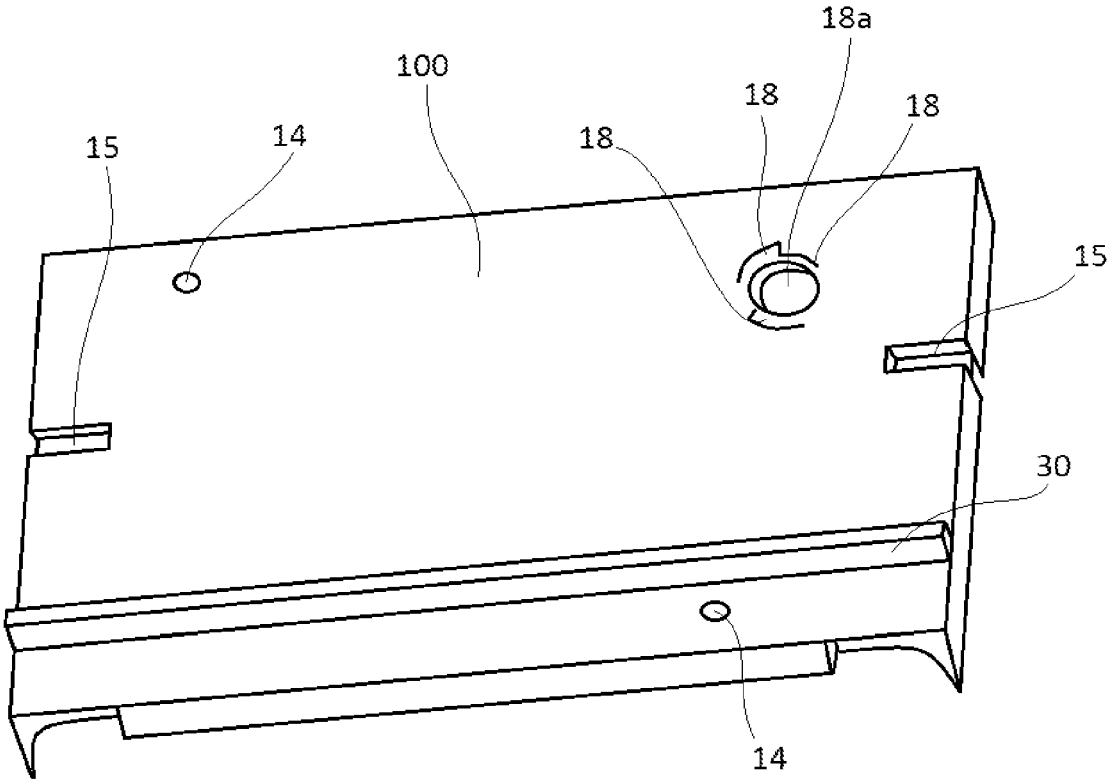
FIG. 2 shows a substantially bottom up view of an exemplary embodiment of a tray, according to an exemplary embodiment of the present disclosure.
Figure 3:
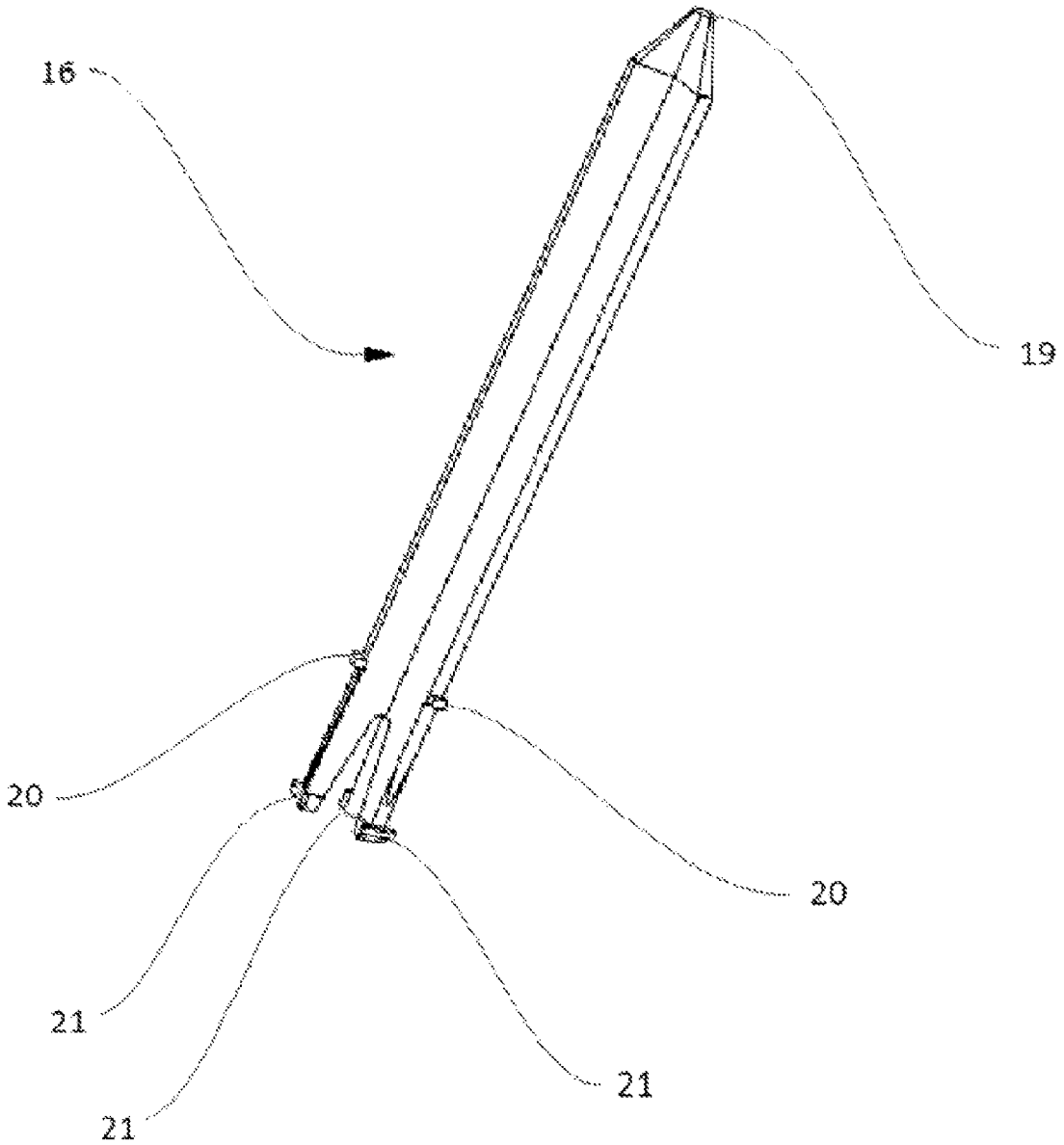
FIG. 3 shows a side view of a removably attachable dowel, according to an exemplary embodiment of the present disclosure.

FIG. 2 illustrates a substantially bottom up view of an example of a tray 100 according to various embodiments of the present disclosure. In this example, tray 100 is shown with two drain holes 14 and two mounting slots 15. Also shown is an aperture 18*a* configured to receive the base of the removable dowel 16. In some embodiments, the aperture 18*a* may be surrounded by female grooved notches 18 which are configured to accept the base of the dowel 16 as depicted in FIG. 3. FIG. 2 also shows an exemplary lip 30, extending outward from underside of tray 100, so to limit potential movement of tray 100 relative to an aerial bucket or componentry used in connection therewith. For example, and with tray embodiments having lip 30, lip 30 may either rest against a portion of an aerial bucket or componentry used in connection therewith, or otherwise prevent movement of tray 100 past said portion or componentry, for example.

FIG. 3 illustrates a side view of a removable dowel 16 according to various embodiments of the present disclosure. Dowel 16 may have a substantially blunt pointed end 19 capable of accepting hardware such as nuts and washers.

Dowel stop guides 20, in various embodiments, prevent dowel 16 from being over inserted into stanchion 17. In the example shown in FIG. 3, dowel 16 terminates into three notched sections 21, which when inserted and twisted into aperture 18*a* depicted in FIG. 2, compress and lock into grooved notches 18. Twisting dowel 16 in the reverse direction and pulling disengages and decompresses notched sections 21 from grooved notches 18 depicted in FIG. 2 allowing removal of dowel 16 from aperture 18*a* and tray 100. Dowel 16 may be of a diameter capable of accepting a wide size range of hardware common in the art. In some embodiments, dowel 16 may be about 0.5 inches in diameter. In other embodiments, dowel 16 diameter may be between 0.25 inches and 3 inches. In some embodiments, dowel 16 is about 3.5 inches in length. In other embodiments, dowel 16 is between 3 inches and 8 inches. In further embodiments the dowel 16 is between 2 inches and 12 inches or any suitable length or diameter.

Although a specific example is provided for a dowel 16 by FIG. 3, other shapes and sizes of dowels or vertical rods are contemplated herein which may be permanently or removably attached to a tray 100 in accordance with various embodiments of the present disclosure.

Figure 4:
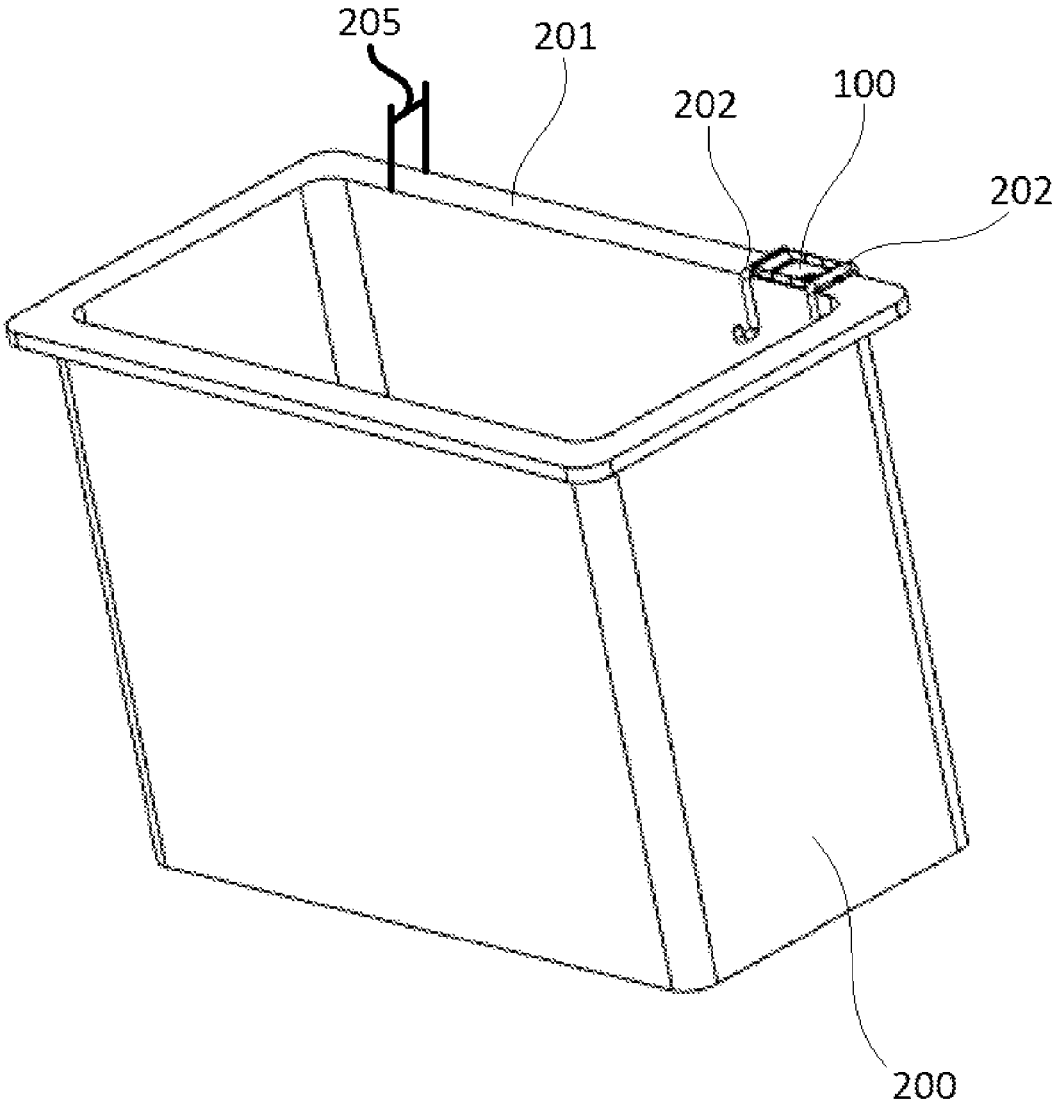
FIG. 4 depicts a substantially top down view showing an example of a tray with dowel attached to the lip of an aerial bucket, according to an exemplary embodiment of the present disclosure.

FIG. 4 depicts a substantially top down view showing an example of a tray 100 attached to a lip 201 of an aerial bucket 200 (sometimes called an "aerial work station"). In this example, tray 100 is secured to aerial bucket lip 201 by two aerial bucket hooks 202. Aerial bucket hooks 202 fit into the attachment saddles 12 depicted in FIGS. 1A and 1B providing a removable attachment means. In some embodiments, trays 100 of the present disclosure are configured for use with aerial bucket lips 201 that are about 3 inches in width (as indicated by width 205 in FIG. 4), resulting in a tray 100 with a width of about 3 inches. In other embodiments, trays 100 of the present disclosure are configured for use with aerial bucket lips 201 that are about 2 inches in width 205, resulting in a tray 100 with a width of about 2 inches. In further embodiments, trays 100 of the present disclosure are configured for use with aerial bucket lips 201 that are a width 205 common in the art, resulting in a corresponding width of the tray 100 that may be the same width as the width of the aerial bucket lip 201, or even a smaller or larger width than the aerial bucket lip 201. For example, and in at least one embodiment, an exemplary tray 100 of the present disclosure has a width of or about 3", noting that an exemplary aerial bucket lip 201 is at or about 2.5". An exemplary bucket hook 202, as referenced herein, is larger than a corresponding width of an aerial bucket lip 201 due to the radius needed to extend around the aerial bucket lip 201, which in various embodiments is thick and straight and generally has no radius at the outer lip and an approximate 0.5" radius at the inner lip. As such, an exemplary aerial bucket lip 201 has a width of 2.5", including the inner radius, and a corresponding tray 100 with a 3" width would fit thereon and be held in place using one or more bucket hooks 202. In some embodiments, the length of tray 100 may be about 6 inches. In other embodiments, tray 100 may be between 4 inches and 10 inches in length. In further embodiments, tray 100 may be longer than 10 inches. In some embodiments, tray 100 may comprise more than two attachment saddles 12, two or more dowels 16, two or more interior tray sections 10, and/or two or more stanchions 17.

Figure 5A:
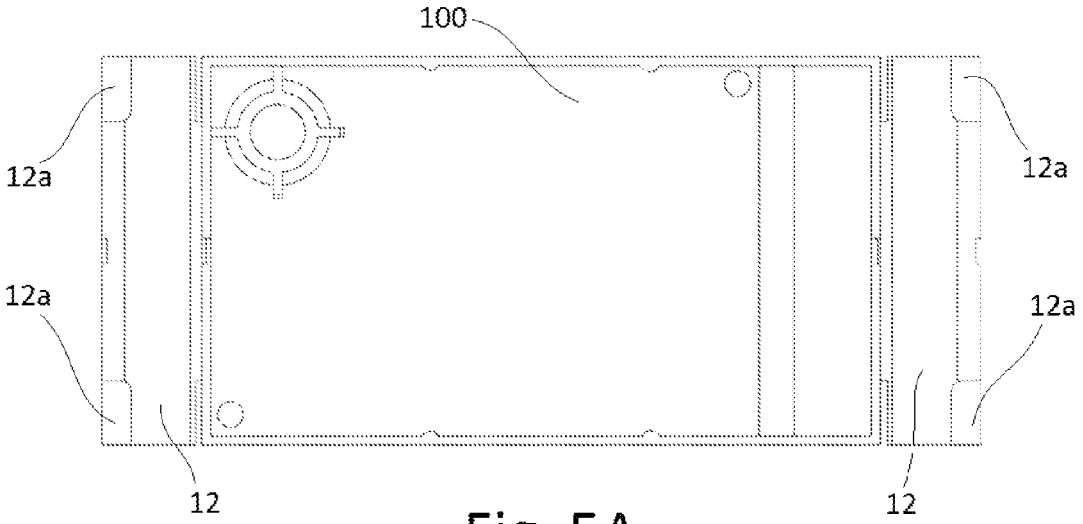
FIG. 5A shows an example of a tray wherein the tray comprises two attachment saddles on each end with each attachment saddle containing at least one stress relief section, according to an exemplary embodiment of the present disclosure.
Figure 5B:
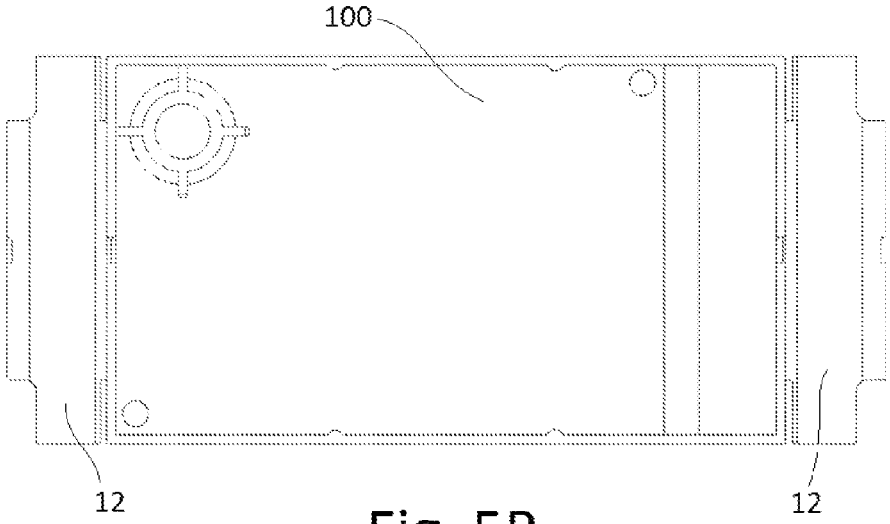
FIG. 5B shows a tray having two attachment saddles but no stress relief sections, according to an exemplary embodiment of the present disclosure.

FIG. 5A shows an example of a tray 100, whereby tray 100 comprises two attachment saddles 12 on each end, with each attachment saddle 12 comprising at least one stress relief section 12*a*. The one or more stress relief sections 12*a* or cutout sections are designed to reduce the stress placed onto the attachment saddle 12 and tray 100 by attachment devices such as aerial bucket hooks 202 which may be weighed down by bags containing heavy tools and equipment. FIG. 5B shows a tray 100 embodiment of the present disclosure without stress relief sections 12*a*.

Figure 6:
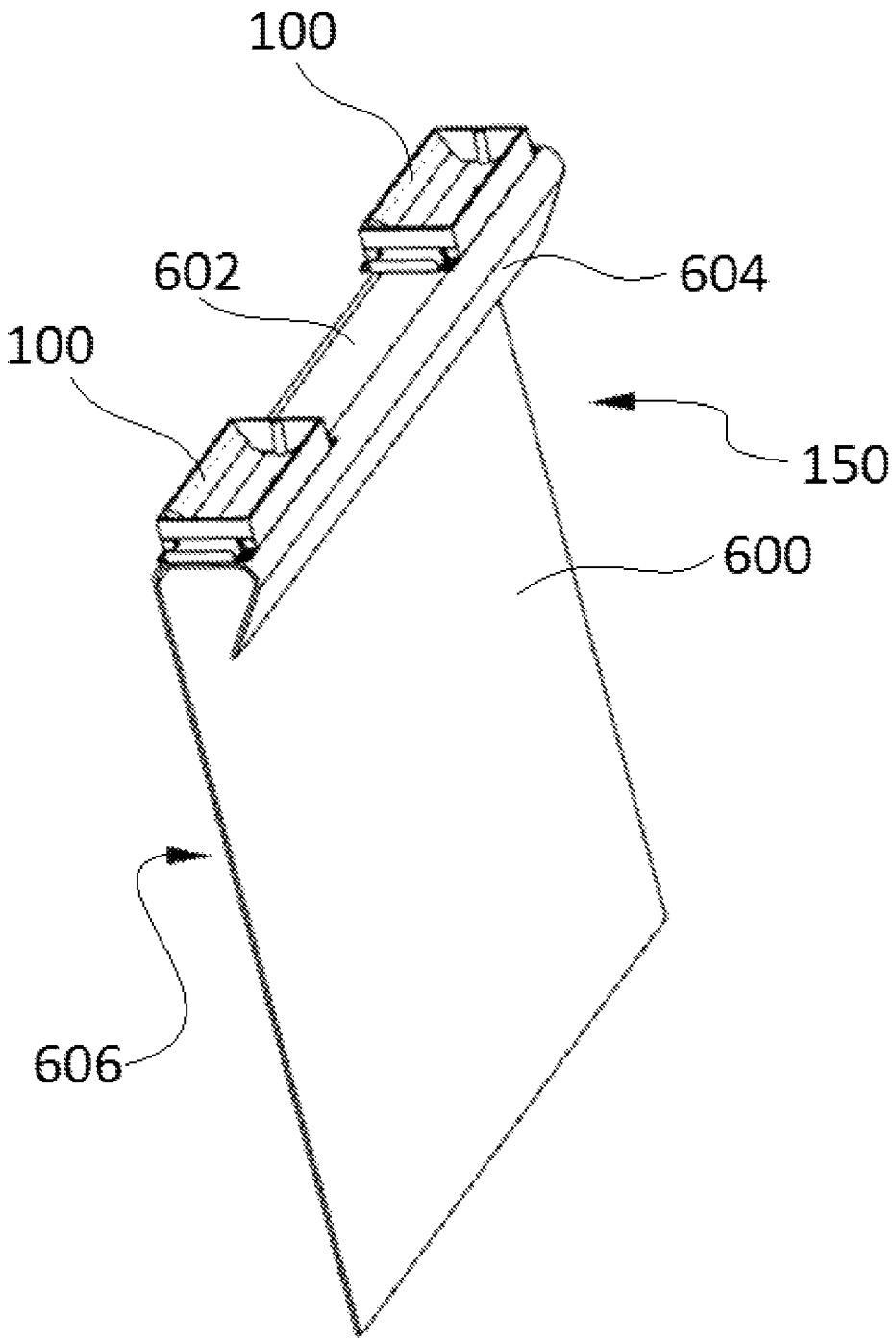
FIG. 6 shows a perspective view of a system comprising a tool board and two trays, according to an exemplary embodiment of the present disclosure.

FIG. 6 shows an exemplary system 150 embodiment of the present disclosure, comprising at least one tray 100 (two trays 100 shown in the exemplary embodiment) and a tool board 600, whereby tray(s) 100 are coupled to, or formed as part of, tool board 600. Tool boards 600 are configured to couple to (or rest upon) part of aerial bucket 200, such as at bucket lip 201, so that an underside of an upper portion 602 of tool board 600 rests upon bucket lip 201. Tray(s) 100, as shown in FIG. 6, are configured for placement at upper portion 602 of tool board 600, so that the innermost portion of tray 100 faces upward and can receive items such as nuts, bolts, and washers, for example. Tool boards 600, in various embodiments, comprise or have an outer lip 604 formed thereon or therein, so that when tool board 600 is placed upon bucket lip 201, tool board 600 will not fall off of aerial bucket 200 due to outer lip 604 on one side and front panel 606 of tool board 600 on the other side (whereby front panel 606 extends downward from upper portion 602 as shown in FIG. 6), and inside an aerial bucket 200 when in use.

Figure 7A:
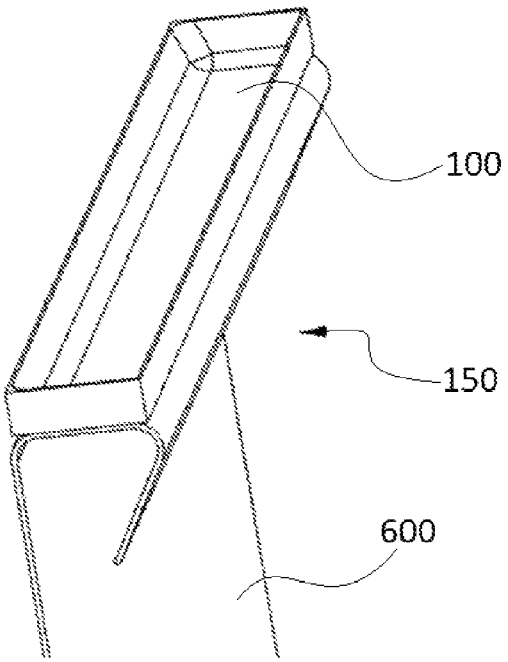
FIG. 7A shows a perspective view of an upper portion of a system, according to an exemplary embodiment of the present disclosure.

FIG. 7A shows a perspective view of an upper portion of an exemplary system 150 of the present disclosure, comprising one tray 100 and a tool board 600, whereby tray 100 and tool board 600 are coupled to one another or formed as a unitary piece (such as a one-piece manufactured piece). In such a system 150 embodiment, for example, tray 100 (referred to as tray portion 100 of system 150) would not require attachment saddles 12, as tray 100 would be coupled to, or formed as part of, tool board 600, and tool board 600 would be configured to rest on aerial bucket 200 when in use. Tray 100 (or tray portion 100) could have attachment saddles 12 in such an embodiment, but they would not be necessary as bucket hooks 202 would not be used.

Figure 7B:
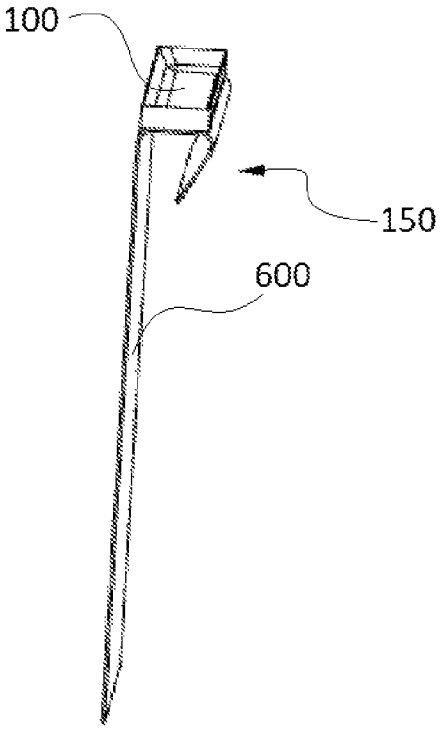
FIG. 7B shows a perspective view of a system comprising a tool board and one tray, according to an exemplary embodiment of the present disclosure.
Figure 7C:
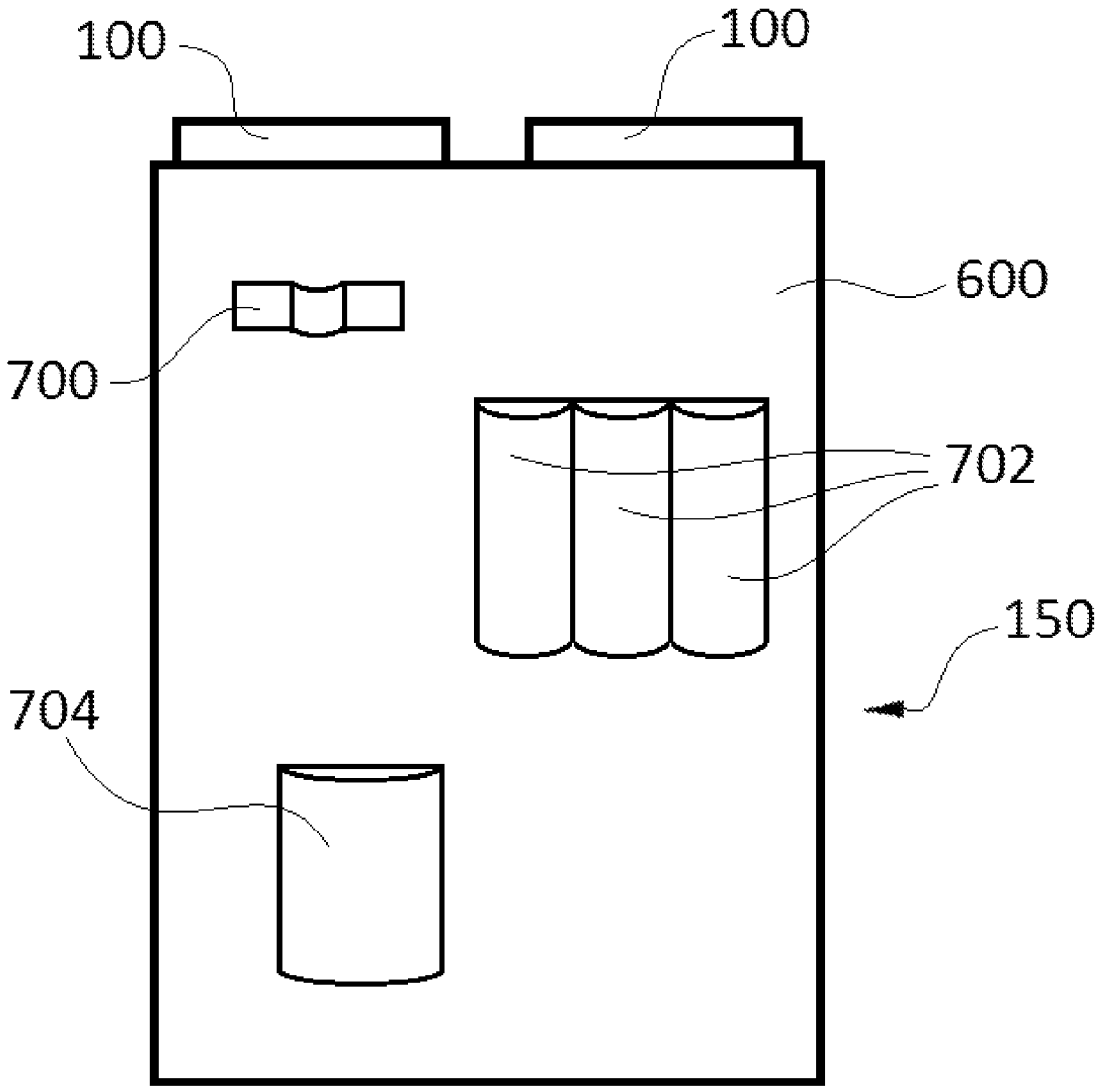
FIG. 7C shows a front view of a system comprising a tool board with one or more features/components thereon and two trays, according to an exemplary embodiment of the present disclosure.

FIG. 7B shows a side perspective view of an exemplary system 150 of the present disclosure, comprising a tray 100 and a tool board 600. FIG. 7C shows an exemplary system 150 of the present disclosure, with a tool board 600, two trays 100 (noting that one or more trays 100 could be used), and one or more other features, such as, for example, one or more loops 700 configured to retain one or more tools, for example, one or more pockets 702, and/or one or more pouches 704 coupled thereto and/or otherwise defined thereon. For example, and in at least one system 150 embodiment, a user of system 150 could place nuts and bolts within tray 100, for example, and store tools within one or more of a loop 700, pocket 702, and/or pocket 704 of tool board 600.

Figure 8:
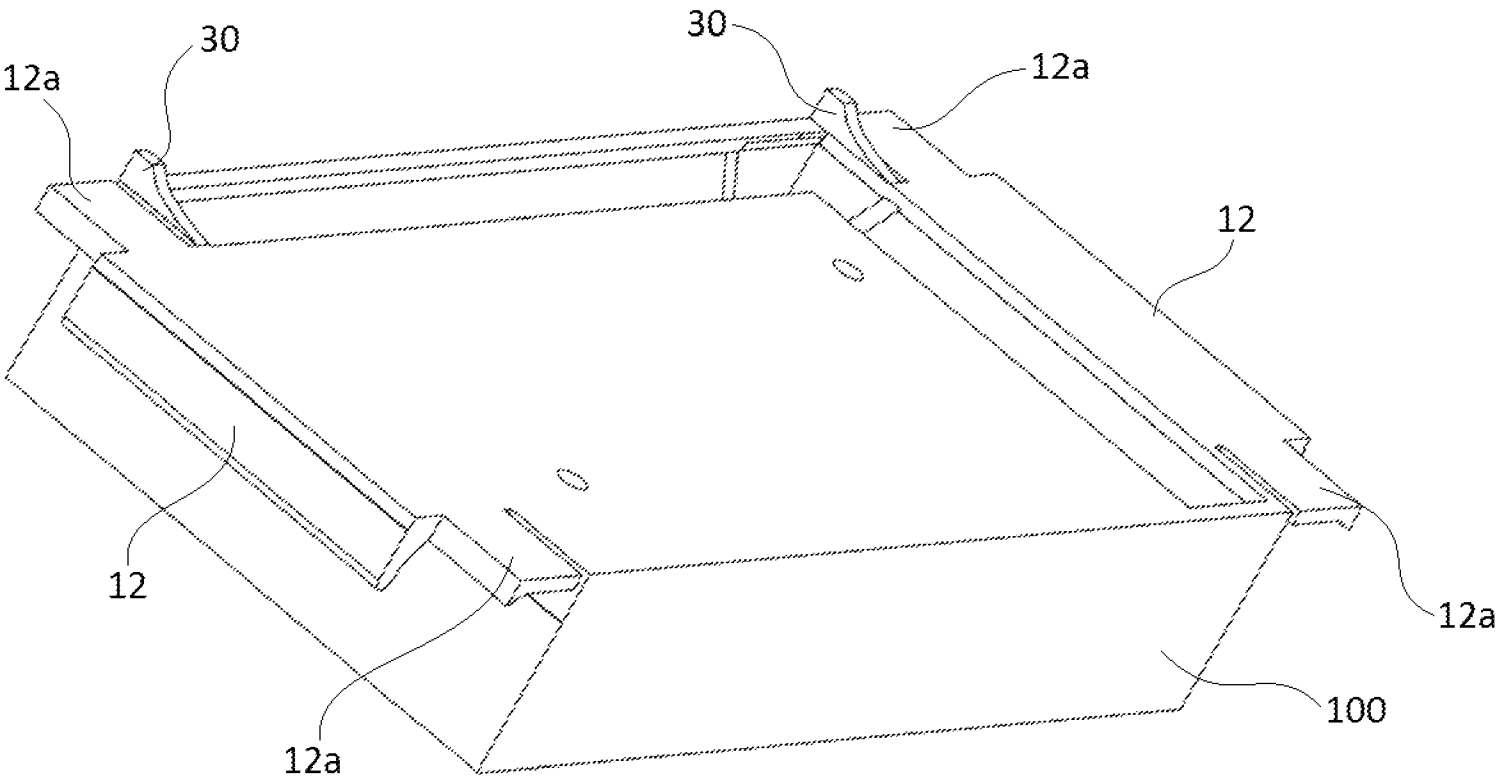
FIG. 8 shows an underside perspective view of a tray, according to an exemplary embodiment of the present disclosure.

FIG. 8 shows a perspective view of an underside of an exemplary tray 100 of the present disclosure. As shown therein, tray 100 comprises two lips 30, extending outward from underside of tray 100, so to limit potential movement of tray 100 relative to an aerial bucket or componentry used in connection therewith.

In various embodiments, tray 100, dowel 16, stanchion 17, and/or other components discussed herein may be constructed of one or more types of molded plastic or other non-electrically conductive materials common in the art. In other alternative embodiments, tray 100 and/or other components may be made of wood, plastic, fiberglass, carbon fiber, aluminum, metal alloys, or a combination of materials common in the art.

While various embodiments of tool trays and systems and methods to use the same have been described in considerable detail herein, the embodiments are merely offered as non-limiting examples. It will therefore be understood that various changes and modifications may be made, and equivalents may be substituted for elements thereof, without departing from the scope of the present disclosure. The present disclosure is not intended to be exhaustive or limiting with respect to the content thereof.

Further, in describing representative embodiments, the present disclosure may have presented a method and/or a process as a particular sequence of steps. However, to the extent that the method or process does not rely on the particular order of steps set forth therein, the method or process should not be limited to the particular sequence of steps described, as other sequences of steps may be possible. Therefore, the particular order of the steps disclosed herein should not be construed as limitations of the present disclosure. In addition, disclosure directed to a method and/or process should not be limited to the performance of their steps in the order written. Such sequences may be varied and still remain within the scope of the present disclosure.

The invention claimed is:

1. A system, comprising:

a first tray, comprising:

an interior tray section configured to receive one or more items, the interior tray at least partially surrounded by at least one sidewall having a height, the height being less than a width and less than a length of the first tray; and a first ramp portion in communication with the interior tray section, the first ramp portion defining a sloping surface that extends from the interior tray section to a top of the at least one sidewall; and a tool board comprising at least one pocket, wherein the first tray is coupled to or configured as part of the tool board;

wherein the system is configured so that when the system is in a use position of the system on a lip of an aerial bucket, the first tray is located completely above the lip and the tool board is positioned within the aerial bucket.

2. The system of claim 1, further comprising:

a second tray coupled to or configured as part of the tool board, the second tray comprising a second interior tray section and a second ramp defining a sloping surface in communication with the second interior tray section;

wherein the system is configured so that when the system is positioned upon the lip of the aerial bucket, the second tray is located completely above the lip.

3. The system of claim 1, further comprising:

one or more components coupled to the tool board.

4. The system of claim 1, further comprising:

a stanchion formed in or coupled to an interior tray section, the stanchion configured to engage a removable dowel; and the removable dowel, configured to reversibly engage the stanchion.

5. A system, comprising:

a first tray, comprising:

an interior tray section configured to receive one or more items, the interior tray at least partially surrounded by at least one sidewall having a height; and a first ramp portion in communication with the interior tray section, the first ramp portion defining a sloping surface that extends from the interior tray section to a top of the at least one sidewall; and at least one additional component connected thereto;

wherein the first tray further comprises at least one attachment saddle coupled to the interior tray section, the at least one attachment saddle configured to receive a portion of an aerial bucket hook; and wherein the system is configured so that when the system is positioned on a lip of an aerial bucket and secured using the aerial bucket hook, the first tray is located completely above the lip of the aerial bucket.

6. The system of claim 5, wherein the at least one additional component comprises a stanchion coupled to the tray.

7. The system of claim 6, further comprising:

a dowel configured for reversible engagement with the stanchion.

8. The system of claim 5, wherein the at least one additional component comprises a tool board coupled to the tray.

* * * * *